US006250014B1

(12) United States Patent
Rusiana

(10) Patent No.: US 6,250,014 B1
(45) Date of Patent: Jun. 26, 2001

(54) COMPACT DOOR COORDINATOR

(75) Inventor: Arturo Rusiana, Algonquin, IL (US)

(73) Assignee: Architectural Builders Hardware Mfg. Co., IL (US)

( * ) Notice: Subject to any disclaimer, the term of this patent is extended or adjusted under 35 U.S.C. 154(b) by 0 days.

(21) Appl. No.: 09/567,414

(22) Filed: May 9, 2000

Related U.S. Application Data

(60) Provisional application No. 60/148,931, filed on Aug. 12, 1999.

(51) Int. Cl.[7] ..... E05C 7/05
(52) U.S. Cl. ..... 49/367
(58) Field of Search ..... 49/366, 367, 369; 16/82; 292/342, DIG. 21

(56) References Cited

U.S. PATENT DOCUMENTS 3,895,461 * 7/1975 Maynard et al. ..... 49/367
4,429,492 2/1984 Imhoff .
4,949,505 8/1990 Cohrs .
5,033,234 7/1991 Simon .
5,582,472 12/1996 Lyons .
5,651,216 7/1997 Tillman .

FOREIGN PATENT DOCUMENTS

630811 * 11/1961 (CA) ..... 49/367

* cited by examiner

*Primary Examiner*—Jerry Redman
(74) *Attorney, Agent, or Firm*—Patnaude & Videbeck

(57) ABSTRACT

The present invention is a compact door coordinator which includes a relatively narrow housing having mounted therein and extending therefrom a lead control lever and a longer trailing control lever. Both control levers are spring biased to extend from the housing when the doors are open. A relatively simple linkage extends from the lead control lever to the trailing control lever for retaining the ladder in its extended position until the lead door contacts the lead control lever. At that point, the lead control lever is pushed into the housing and rotated against the force of a torsion spring, causing the linkage to move and thereby rotating a cam which then releases the trailing control lever allowing the trailing door to push the trailing control lever into the housing to complete the closing process. When the doors are reopened, the force of the torsion springs causes the lead and trailing levers to once again extend from the housing while resetting the cam to retain the trailing lever in its extended position until it is released.

13 Claims, 8 Drawing Sheets

COMPACT DOOR COORDINATOR

This application claims benefit of U.S. Provisional Ser. No. 60/148,931 filed Aug. 12, 1999.

FIELD OF THE INVENTION

The present invention relates to coordinators for controlling the sequential closing of a pair of oppositely hinged swinging doors in which one door is the lead door and the other is the trailing door.

BACKGROUND OF THE INVENTION

Closing off large doorways often requires using a pair of doors, and the latching mechanisms used with such doors often dictate the sequence in which the doors must close to engage the latches. For example, one door may carry the latch mechanism while the remaining door must carry the receiver or striker mechanism. In a single-door doorway, the striker mechanism is mounted to the door frame and engages the latch mechanism when the door is closed. In the foregoing example, the door carrying the receiver or striker mechanism will be called the "lead door" meaning that this door must be closed first in order to correctly engage the latching mechanism. The remaining door carrying the latching mechanism will be called the "trailing door." Other door arrangements include an overlapping strip or astragal intended to close off any gap that may exist between the doors when they are in the fully closed position. The astragal must be mounted to the trailing door to allow the doors to close.

Door closing coordinators are well known in the art and serve the function of controlling the sequence in which the lead and trailing doors close. Door closing coordinators are commonly used in conjunction with doors that have some type of automatic door closing mechanism that will move a door from an open to a closed position after the door has been released. Carrying the foregoing example a bit further both the lead and trailing doors have automatic door closing mechanisms which will move the doors to a closed position and it is the coordinator's task to ensure that the lead door reaches a fully closed position before the trailing door regardless of the relative positions the doors are in when they are released, the speed with which each door closes, or other variables.

U.S. Pat. No. 4,429,492 (Imhoff) teaches and describes a door coordinator for a pair of oppositely hinged doors which controls the sequence in which the doors close by placing a stop proximate the hinge edge of the trailing door which props the door open sufficiently to allow the lead door to clear it and close. A release mechanism is contacted by the lead door which then allows the trailing door to close. Such door coordinators are preferably installed in the overhead portion of the door frame or are attached to the overhead portion of the door frame.

U.S. Pat. No. 5,033,234 (Simon et al) teaches and claims a door coordinator having a door stop which contacts the trailing door proximate the hinge edge of the door and a release mechanism which is contacted by the lead door intermediate the hinge edge and free edge of the lead door.

U.S. Pat. No. 4,949,505 (Cohrs) teaches and describes a door coordinator having a door stop which contacts the trailing door intermediate the hinge and free edges of the door and a release which, when contacted by the trailing door, releases the door stop. This patent uses a sliding carriage mechanism which extends between the door stop and the door release.

U.S. Pat. No. 5,651,216 (Tillmann) teaches and describes a door closer for a two-panel door with a closing sequence controlling mechanism having a door stop and door release, both of which are mounted to contact the doors proximate the hinge edges of the doors.

U.S. Pat. No. 5,582,472 (Lyons) teaches and describes a solvent storage cabinet having a door sequence control mechanism which allows the cabinet to close and latch in the event of a fire.

A product manufactured by the Triangle Brass Manufacturing Company of Los Angeles, Calif. designated as its 3092 Retracting Door Coordinator has a pair of arms of unequal length extending from an elongated housing. The longer of the two arms contacts the trailing door and holds it in an open position until the lead door contacts the shorter of the two arms, allowing the doors to close. The mechanism used with the Model 3092 Retracting Door Coordinator requires that the housing have a protuberance extending therefrom to enclose the timing mechanism.

The present invention relates to door coordinators of the general type illustrated by the Model 3092 coordinator that provide new, improved and more compact construction by enclosing the operating mechanism in a housing which is uniform in cross sectional area throughout and which is sufficiently compact to allow ease of installation while at the same time providing a narrow profile and attractive appearance.

SUMMARY OF THE INVENTION

The present invention includes a relatively narrow housing consisting of an aluminum tube with a rectangular cross-sectional configuration from which extend a lead control lever and a trailing control lever with the trailing control lever being longer than the lead control lever. Both control levers are spring biased to extend from the housing when the doors are open. A relatively simple linkage extending from the lead control lever to the trailing control lever retains the trailing control lever in its extended position until the lead door contacts the lead control lever, at which point the lead control lever is pushed into the housing and rotated against the force of the torsion spring, causing the linkage to move and thereby rotating a cam which then releases the trailing control lever allowing the trailing door to push the trailing control lever into the housing to complete the closing process.

When the doors are reopened, the force of the torsion springs causes the lead and trailing levers to once again extend from the housing, while resetting the cam to retain trailing lever in its extended position until it is released.

The mechanism is designed to have a pre-set release force at which point the trailing control lever will disengage and allow the trailing door to close even though the lead door has not yet closed. This feature is intended to prevent damage to the trailing door.

In yet another version of the present invention, means are provided to adjust the release force of the trailing control lever.

BRIEF DESCRIPTION OF THE DRAWINGS

These and further aspects of the present invention may better be understood by referring to the accompanying drawings in which.

It is an object of the present invention to provide door coordinator mechanisms which are compact in shape and which operate by contacting the lead and trailing doors at a point distal from the hinge edge of the doors to reduce the force that must be maintained to hold each of the doors in an open position.

It is a further object of the present invention to provide such door coordinators and forms where the release force exerted by the lead control lever is adjustable.

While the following describes a preferred embodiment or embodiments of the present invention, it is to be understood that this description is made by way of example only and is not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein described and claimed.

DETAILED DESCRIPTION OF THE DRAWINGS

Figure 1:
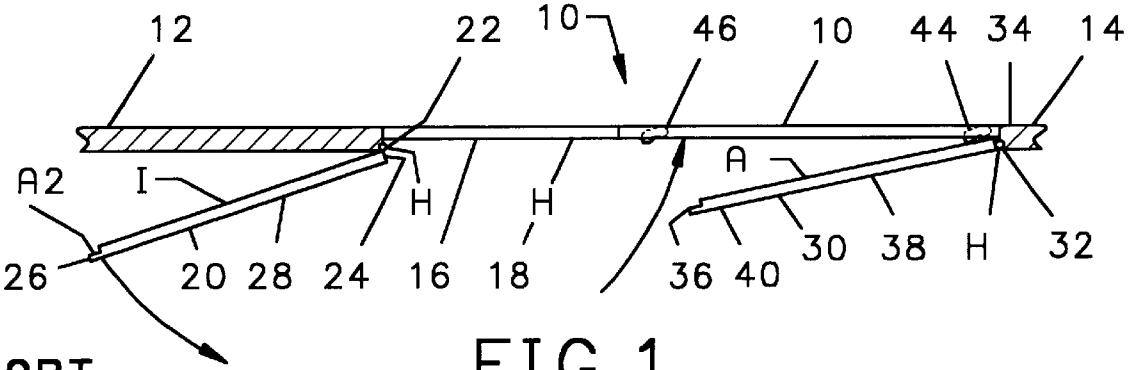
FIG. 1 PRIOR ART
FIG. 1 is a sectional view of a prior art door coordinator taken from U.S. Pat. No. 4,429,492.

Referring now to FIG. 1, the numeral 10 identifies generally a doorway of the type requiring two doors to close off the door opening. The view of FIG. 1 taken in an overhead sectional view has a first wall 12 and a second wall 14 defining the left and right vertical segments of the door opening defined generally as 16. The remaining portions defining the door opening are the floor (not shown) which may or may not have a door jamb attached to it within opening 16 and the upper frame 18.

A lead door 20 is shown hinged to first wall 12 at hinge 22. For purposes of convenience, throughout the present description, lead door 20 will be described as having a hinge edge 24, which is the vertical edge of door 20 to which hinges 22 are attached, and a free edge 26 which is the vertically extending edge of the door opposite hinge edge 24 and a top edge 28.

FIG. 1 also illustrates a trailing door 30 attached to second wall 14 by hinges 32 and having a hinge edge 34, a free edge 36 and a top edge 38 corresponding to the features described in connection with lead door 20. In the illustration, trailing door 30 has a lip 40 which, when doors 20 and 30 are closed, overlaps door 20, fitting into recess 42 formed along the outer portion of door 20.

In FIG. 1, the door coordinator shown therein has a door stop 44 and a release 46 with the door stop 44 being positioned to contact trailing door 30 proximate hinge edge 34. Holding trailing door 30 open thus requires an appreciable amount of force depending upon the weight of door 30 and the distance from door stop 44 to the distance point at which the door stop 44 contacts door 30 to free edge 36. The longer this distance, the greater force is applied to door stop 44.

Figure 2:
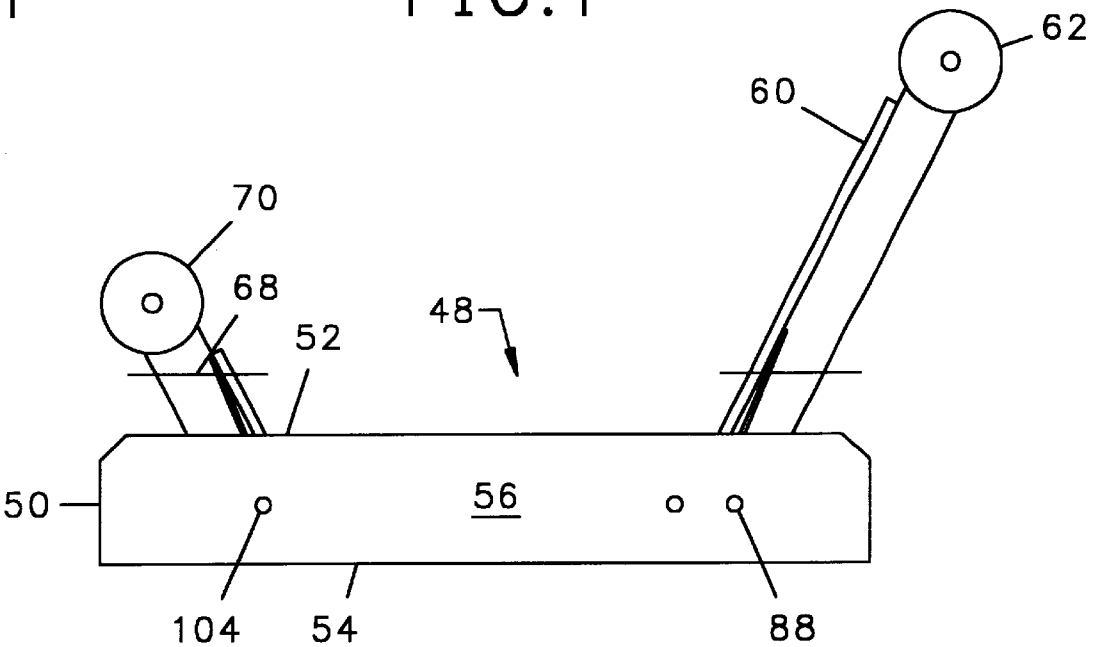
FIG. 2 is a top plan view of the present invention showing the control levers extended therefrom.

Referring now to FIG. 2, the numeral 48 indicates generally a door closing coordinator constructed in accordance with the teachings of the present invention. An elongated cylindrical housing 50 having a generally rectangular cross-sectional configuration has a front wall 52, a rear wall 54, a top 56, and a bottom 58.

A lead lever 60 having a roller 62 rotatably attached at the end thereof by pin 64 extends from housing 50 through lead lever slot 66.

A trailing lever 68 having a roller 70 rotatably attached to the end thereof by pin 72 extends from housing 53 through trailing lever slot 74.

Figure 3:
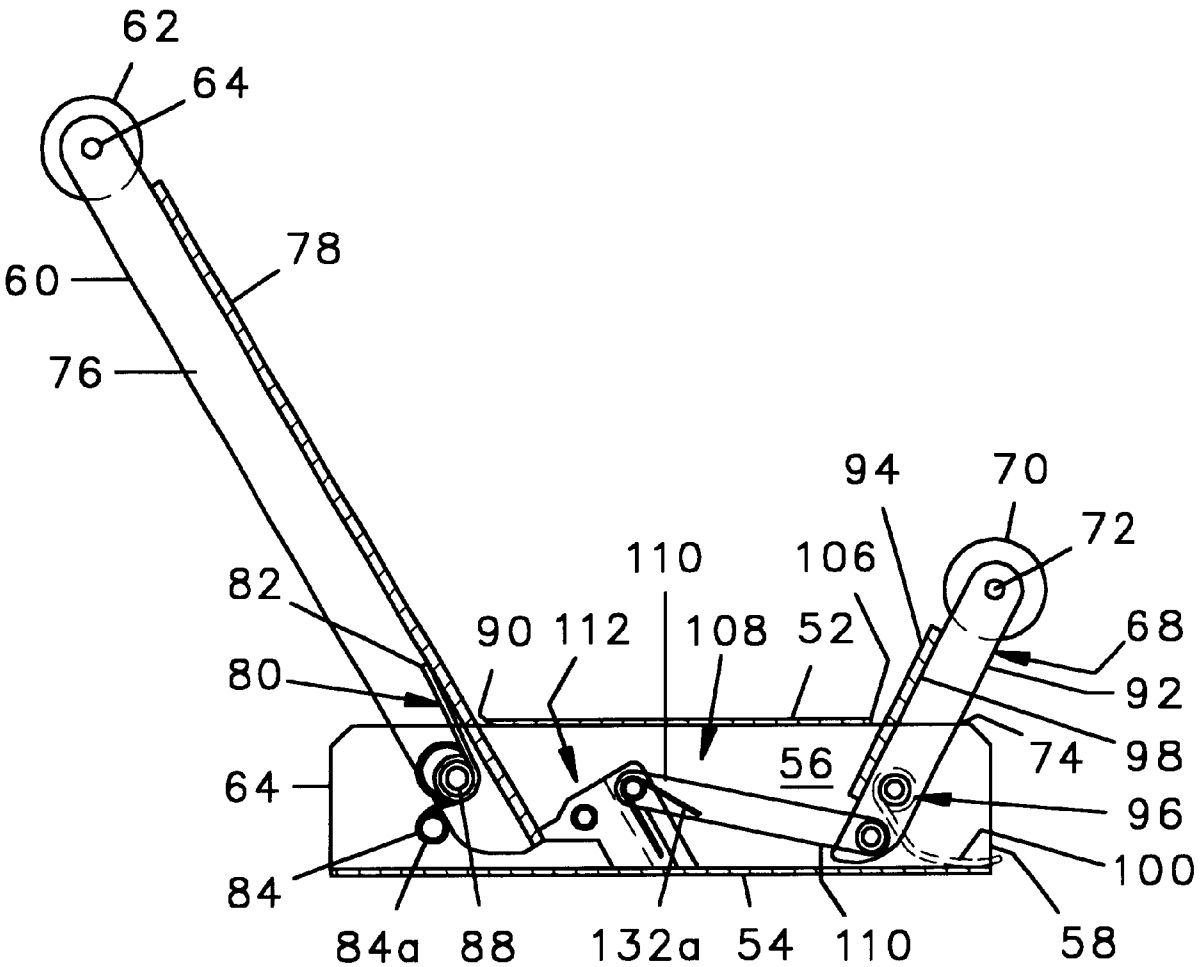
FIG. 3 is a bottom sectional view of the embodiment shown in FIG. 2 taken halfway through the thickness thereof.

As seen in FIG. 3, lead lever 60 and trailing lever 68 are spring-biased to remain in their extended positions. Lead lever 60 is formed in a generally L-shape with a lead lever base 76 integrally formed with a lead lever flange 78 with base and flange meeting at approximately a 90° angle. A lead torsion spring 80 has a first leg 82, a second leg 84, each integrally joined to a coiled center 86. Lead lever 60 is pivotally attached within housing 50 at mounting peg 88. As seen in FIG. 3, lead torsion spring 80 is also mounted to peg 88 at coiled center 86 thereof with first leg 82 resting against flange 78 and second curled portion surrounding pin 84*a* when torsion spring 80 is in its unstressed or non-compressed position. As can be seen, torsion spring 80 is compressed when lever 60 is rotated in a clockwise direction around peg 88 and thus is constantly urging lever 60 to its fully extended position. The outward travel of lever 60 is limited by the contact of flange 78 with the innermost edge 90 of slot 64.

In like fashion, trailing lever 68 is formed with a generally L-shaped cross section with a base 92 and a flange 94 meeting base 92 at approximately a 90° angle. A trailing torsion spring 96 has a first leg 98, a second leg 100 and a coiled center 102, corresponding to spring 80. Lever 68 is pivotally mounted within housing 50 on peg 104 as is torsion spring 96, with first leg 98 contacting flange 94 and second leg 100 contacting the inner surface of rear wall 54. Counterclockwise rotation of trailing lever 68 is thus opposed by torsion spring 96 and torsion spring 96 which urges lever 68 to its outermost protruding position. The outermost rotation of lever 68 is limited by edge 106 of slot 74.

Figure 4:
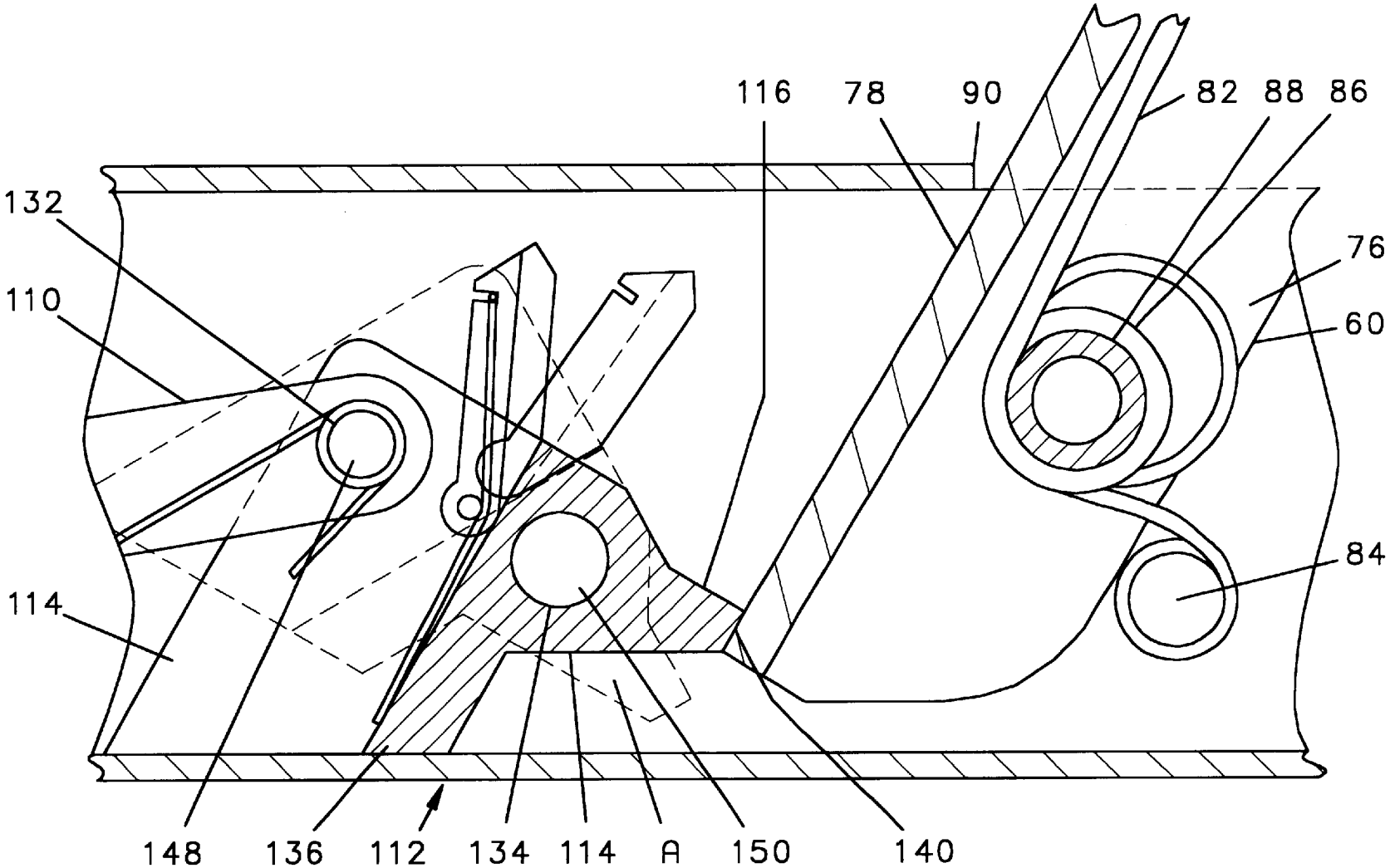
FIG. 4 is an enlarged view of the cam mechanism shown in FIG. 2.

As seen in FIGS. 3 and 4, a linkage 108 has a link 110 which extends from trailing lever 68 to a stop cam assembly 112. Stop cam assembly 112 is designed to hold lead lever 76 is an extended position and resist rotation of lead lever 76 around peg 88 until stop cam assembly is moved by the movement of link arm 110 in response to the movement of trailing lever 68. This mechanical operation will be described in more detail hereinafter.

Figure 5:
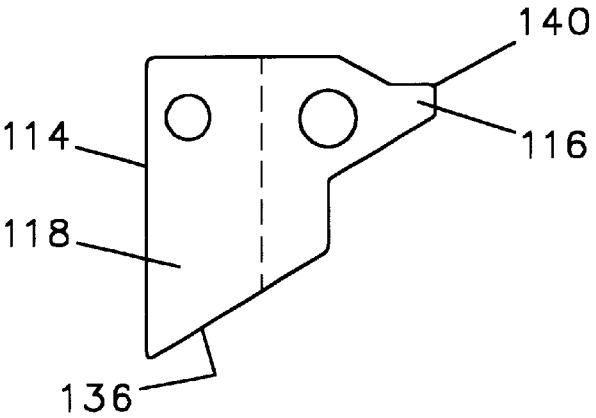
FIG. 5 is a front plan view of the cam.
Figure 6:
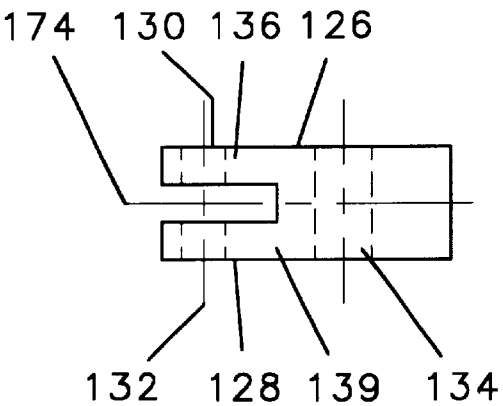
FIG. 6 is a bottom plan view of the cam.

As seen in greater detail in FIGS. 4 and 5, stop cam assembly 112 has a stop cam 114 formed in a generally P-shape with a nose 116 and a stem 118 terminating in a sloped or pitched stem bottom 120. As seen in FIG. 6, stem 122 has a slot 124 milled therethrough forming a pair of stem legs 126 and 128. A pair of apertures 130, 132 are formed through legs 126 and 128, respectively and are coaxially aligned with one another. A central aperture 134 is formed through the P-shaped portion of cam 112 as seen in FIG. 6.

As seen in FIG. 5, the lowermost surfaces 136, 138 of legs 126 and 128 are angled or pitched. As seen in FIG. 4, in its at rest position, cam 114 has end 140 of nose 116 rest against flange 78 of lever 60 while leg bottoms 136 and 138 rest flat against the rear wall 54 of housing 50. In this position, cam 114 prevents lever 60 from rotating about pin 88.

Figure 8:
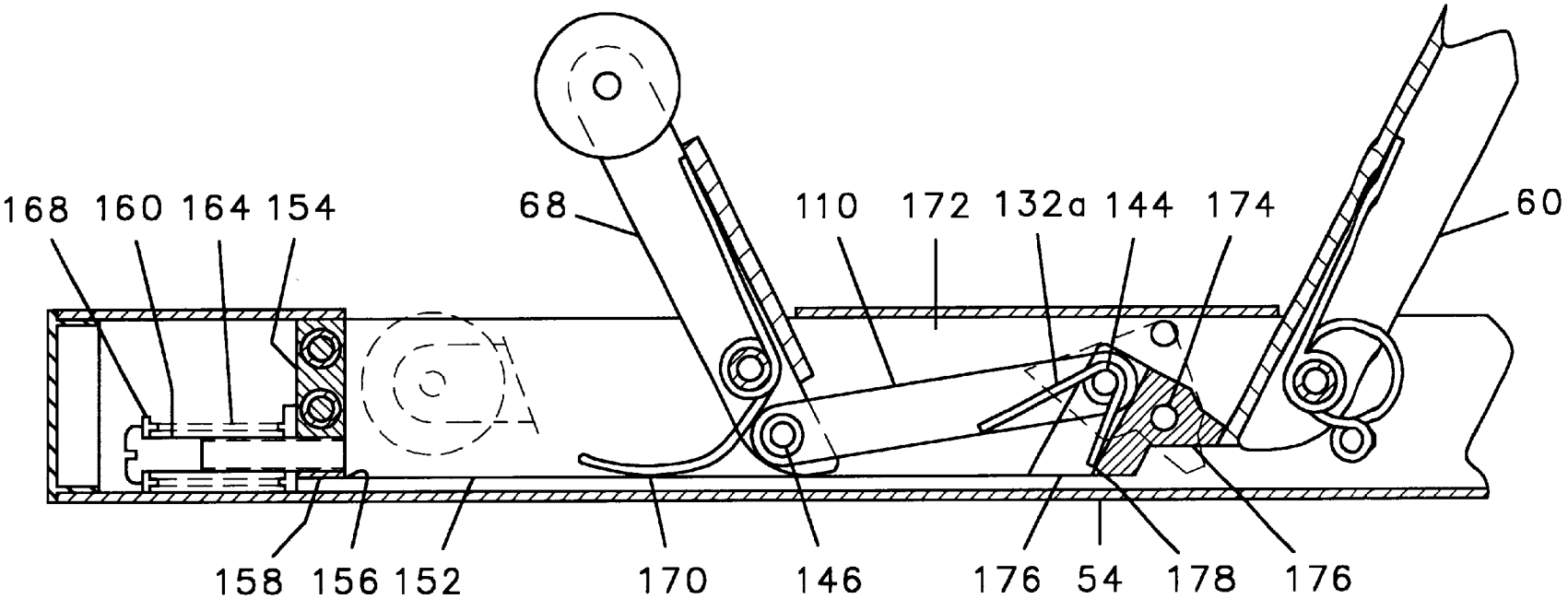
FIG. 8 is an enlarged section view of a second embodiment of the present invention taken similarly to FIG. 3 of the first embodiment showing the release force adjusting mechanism.

Referring now to FIG. 8, it can be seen that link 110 has a first oval shape link aperture 142 formed at one end and a second link aperture 144 formed at the other end. One end of link 110 is slidably attached to lever 68 by pin 146, inserted through aperture 142. Oval aperture 142 provides a lost motion portion for the movement of link 110 that allows the trailing arm 60 to move upwardly without pulling the trailing arm 68 downward. The trailing arm is allowed to stay fully extended and is biased in position by spring 132*a* mounted around pin 132 at one end of link 110.

As seen in FIG. 4, the remaining end of link 110 is pivotally attached to cam 114 by aligning aperture 148 with cam apertures 130 and 132 and passing pin 148 through aligned apertures 130, 144 and 132. As also seen in FIG. 4, cam 114 is rotatably mounted to housing 50 by housing pin 150 which passes through top 56 and bottom 58 of housing 50. In FIG. 5, it can be seen that rotating cam 114 in a clockwise direction will move nose end 140 past the end of flange 78 to position A shown in phantom in FIG. 4, thus releasing lever 60 to rotate about pin 88.

Figure 7:
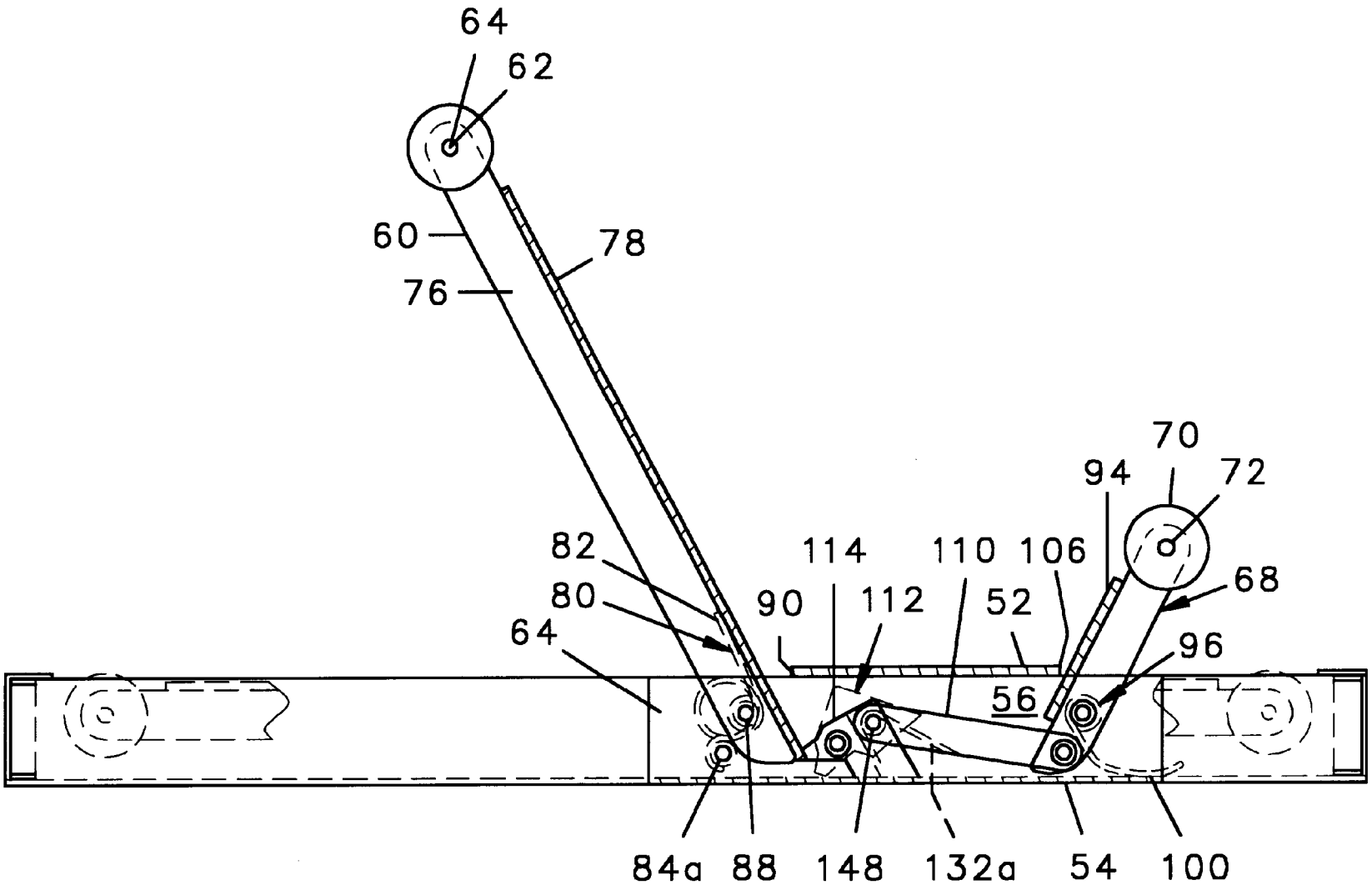
FIG. 7 is a sectional view of the present invention similar to FIG. 3 showing the levers retracted.

As seen in FIG. 7, rotation of cam 114 occurs when lever 68 is itself rotated in a counterclockwise direction to move link 110 which, in turn, pushes against pin 148. Thus, in operation, when trailing door 20 contacts roller 70, lever 68 is rotated in a counterclockwise direction against the force of torsion spring 96 which, in turn, rotates cam 114 in a clockwise direction releasing lever 60 and allowing lever 60 to rotate in a clockwise direction when contacted by trailing door 30. When doors 20, 30 are opened, coordinator 48 is reset as torsion spring 80 and 96 rotate levers 60 and 68 to their extended or outward position while, at the same time, moving link 110 to rotate cam 114 in a counterclockwise position to again secure lever 68 against any movement until lever 60 is itself rotated.

Referring now to FIG. 8, the numeral 152 indicates generally an override release adjusting mechanism which consists of a bracket 154 extending between housing top 56 and housing bottom 58, and sized to leave a gap or passageway 156 between bracket 154 and rear wall 54. Bracket 154 has a threaded aperture 158 through which an adjusting screw 160 is threaded. Surrounding the shank 162 of screw 160 is a coil spring 164, one end of which abuts against washer 166 which, in turn, abuts bracket 154, and the other end of which is held in place by screw head washer 168. Thus, as adjusting screw 160 is threaded into aperture 158, spring 164 is compressed.

An adjusting slide 170 preferably formed as a flat metal segment with a rectangular cross-sectional configuration is inserted into housing 50 through passageway 156. A cam mounting bracket 172 is mounted to slide 170 at the end distal from bracket 154 and has a cam mounting aperture 174 through which mounting pin 176 is used to pivotally mount cam 178. Cam 178 is in its shape, function and operating characteristics substantially the same as cam 114 described above. In FIG. 8, link 110 is attached to cam 178 in the same fashion as described above and serves to rotate cam 178 when arm 68 is pushed in as described above.

Figure 9:
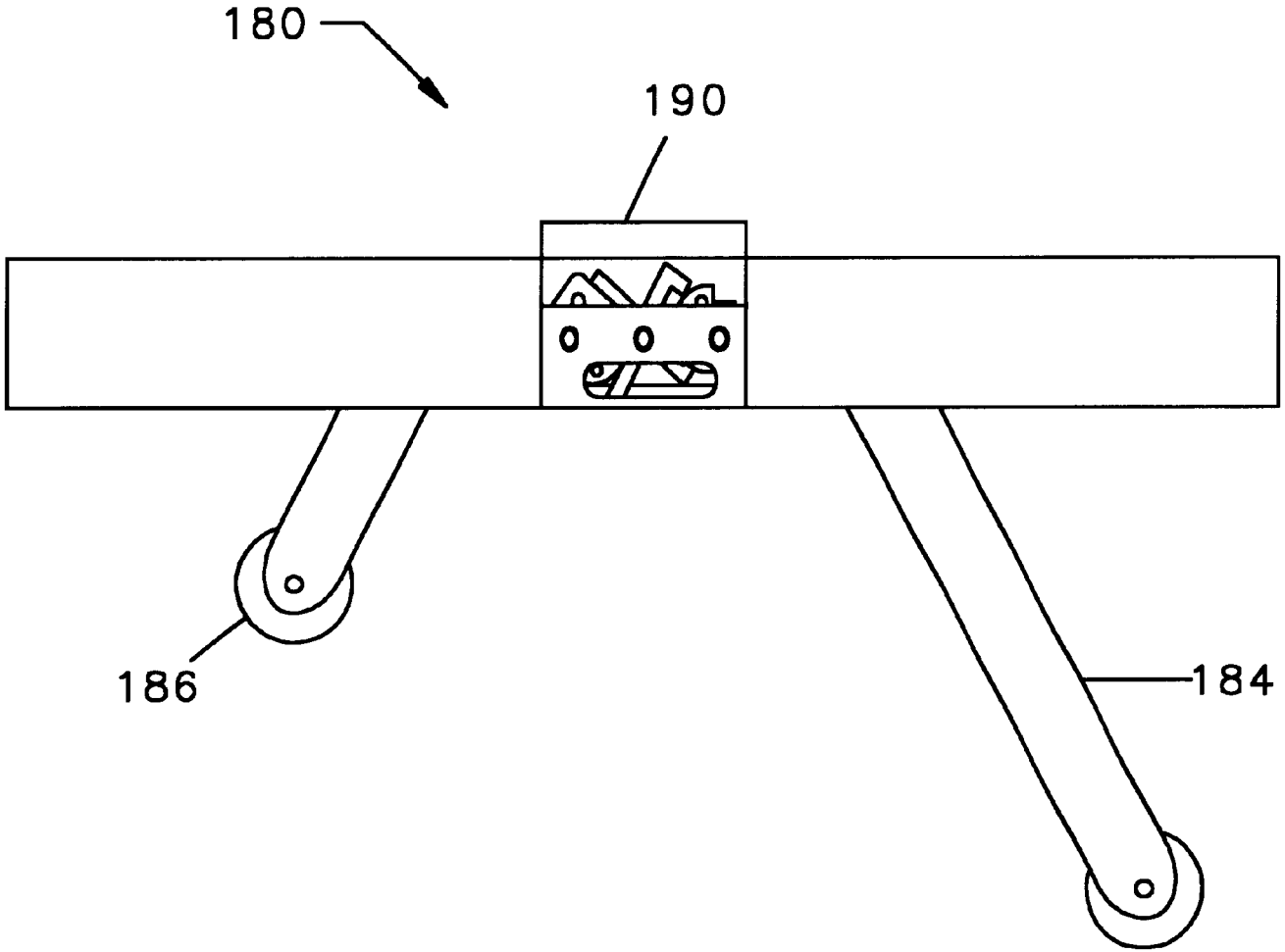
FIG. 9 is a top plan view of the Model 3092 door closer with portions of the case removed to reveal the operating mechanism.
Figure 10:
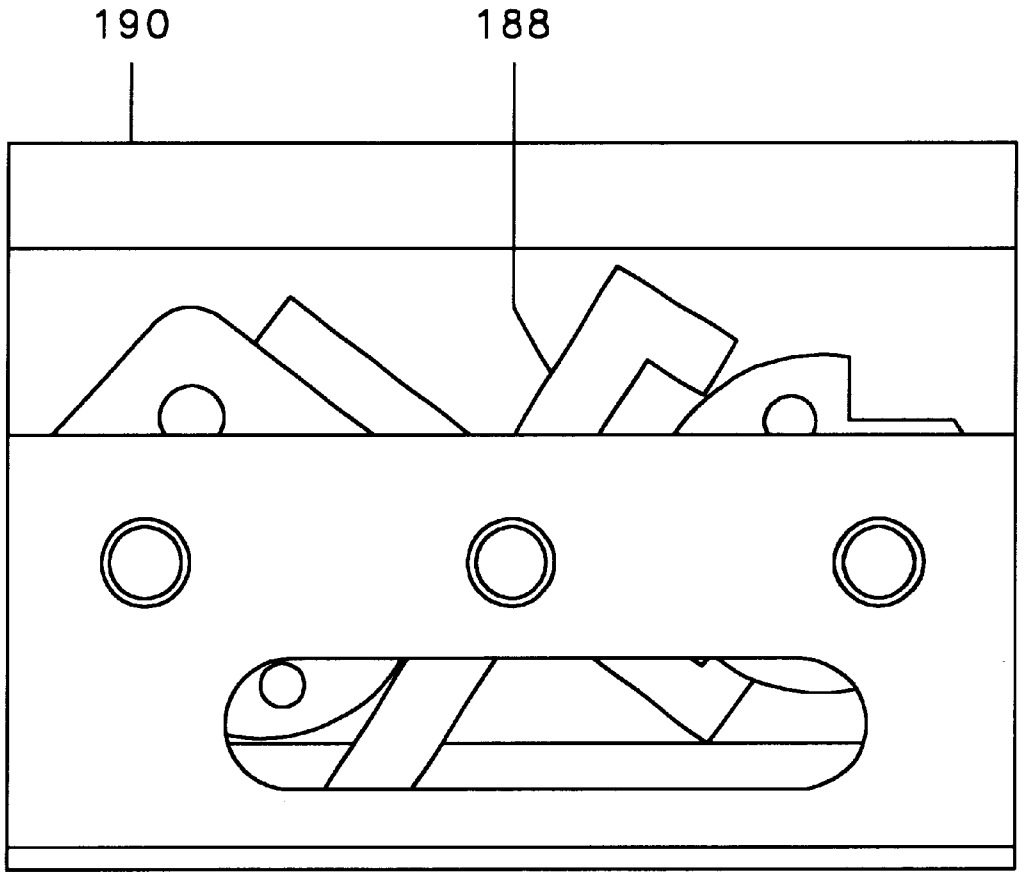
FIG. 10 is an enlarged view of the door closer shown in FIG. 9.

Operation of the release mechanism may now be described. When a sufficiently large force is applied to lead lever 60, the force applied to cam 178 will be sufficient to overcome the force exerted by spring 164 and slide 170 will move leftward (as depicted in FIG. 8) releasing lever 60 from cam 178 and allowing lever 60 to be pushed into housing 50. The force required to release arm 60 may be adjusted by turning adjusting screw 160 to either compress or release spring 164. For more specific applications, springs 164 of different stiffnesses and rates may FIGS. 9 and 10 illustrate the Model 3092 door coordinator described above. As can be seen in both FIGS. 9 and 10, the 3092 coordinator 180 has a housing 182 from which a pair of arms 184, 186 extend in much the same manner as described hereinabove. As best seen in FIG. 10, the timing mechanism 188 used in coordinator 180 requires that the housing be enlarged to accommodate the internal mechanism, resulting in a housing protuberance 190.

The present invention offers advantages over coordinator 180 in that no protuberance is required and the timing mechanism may be wholly contained within a relatively inexpensive aluminum tube which is rectangular in cross-sectional configuration.

Use of the present invention may now be described. Coordinator 48 is held in position along an uppermost surface of door opening 16 while doors 20 and 30 are moved toward a closing position in order to determine where lead lever 60 and trailing lever 68 may best be positioned. When this position is determined, coordinator 48 is secured to upper door frame 18 by the use of conventional threaded fasteners driven thorough mounting holes formed in housing 50 and in a position where doors 20 and 30 may be fully closed as though no coordinator is being used.

When doors 20 and 30 are opened and then released, trailing door 30 will be held by lever 68 until lead door 20 closes to contact lead lever 60. As door 20 continues to move to a fully closed position, lead lever 60 is pushed into housing 50 thereby moving link 110 to rotate cam 114 and release trailing lever 68 which, in turn, allows trailing door 30 to move to a fully closed position.

Applying a predetermined override force to trailing door 30 while it is being propped open by trailing lever 68 will release trailing lever 68 and allow trailing door 30 to close even before lead door 20 has fully closed. Although this means that the doors will close out of sequence, this feature is intended to prevent damage to trailing door 30 in the event that door 30 is struck or hit.

The override force at which trailing lever 30 will release is adjusted by rotating adjusting screw 158 and applying test force to the door to determine the appropriate force setting to use.

While two embodiments of the present invention have been shown and described, it will be understood by those skilled in the art that improvements and modifications may be made within the scope of the invention. Therefore, it is the intent of the appended claims to cover all such changes and modifications which fall within the true spirit and scope of the invention.

What is claimed:

1. A door closing coordinator used to control a sequence in which first and second doors are closed, said coordinator comprising:

a housing, said housing formed as a tube having a uniform cross section along its length, said tube having a front face, a rear wall, a top panel, a bottom panel, a left end and a right end, first and second arms mounted within and extendable from said housing, each said arm having first and second ends, each said arm pivotally attached to said housing proximate said first arm end, said first arm being shorter in length than said second arm;

means for extending said arms outward from said housing to a ready position;

means to retain said second arm in said ready position until said first arm is contacted by said first of said doors and retracted into said housing, said retaining means including a timing cam member engaging said second arm proximate said first end, a link having first and second ends, said first link end pivotally attached to said cam and said second link end pivotally attached to said first arm proximate said first arm and whereby retraction of said first arm into said housing causes said link to rotate said cam to disengage said first end of said second arm allowing said second arm to retract into said housing when contacted by said second door.

2. The apparatus as recited in claim 1 wherein said housing is of sufficient length to allow said first and second arms to retract fully within said housing.

3. The apparatus as recited in claim 1 wherein portions of said front face and portions of said left and right ends are removed to allow said first and second arms to align parallel to an axis extending along the length of said housing to allow a portion of either or both of said retaining arms to extend from said housing when said arms are in said retracted position.

4. The apparatus as recited in claim 1 wherein said cam has a nose portion which contacts said second arm proximate said first end.

5. The apparatus as recited in claim 1 wherein said arm extension means is a spring mounted coaxially with said pivot point of each said arm, each said spring being generally L-shaped and having first and second legs with one said leg contacting one said arm and the remaining said leg contacting one of the interior wall of said housing and a pivot pin.

6. The apparatus as recited in claim 1 wherein said cam is spring-biased to engage said second arm.

7. The apparatus as recited in claim 1 wherein said cam is mounted to said housing by a pivot pin extending through said housing from said top panel to said bottom panel.

8. The apparatus as recited in claim 1 where each said arm is pivotally mounted to said housing by a pivot pin passing through said housing from said top panel to said bottom panel.

9. The apparatus as recited in claim 1 including means to adjust the amount of force required to disengage said second arm when said second arm is engaged with said cam, said adjusting means including a sliding plate having a bracket mounted thereon, said cam pivotally mounted to said bracket;

and means to adjust the force necessary to move said plate and thereby said cam.

10. The apparatus as recited in claim 9 wherein said adjusting means comprises a mounting plate mounted within said housing and having a capped hole formed therethrough, an adjusting screw threadedly inserted through said hole, a coil spring positioned concentrically through said screw, a washer positioned between said coil spring and said mounting plate, said sliding plate contacting said washer whereby adjusting the distance to which said screw is turned into or out of said bracket adjusts the force with said screw, spring and washer combination resists the movement of said plate.

11. The apparatus as recited in claim 1 said second link end includes means for providing lost motion between said second link end and said first arm allowing said second arm to move from a retracted to an extended position without pulling said first arm downward.

12. The apparatus as recited in claim 11 wherein said means for providing lost motion is an oval aperture at said second link end.

13. The apparatus as recited in claim 12 wherein said link is biased at one end of said oval aperture against said lead arm.

* * * * *